US005383638A

United States Patent [19]

Dieringer et al.

[11] Patent Number: 5,383,638

[45] Date of Patent: Jan. 24, 1995

[54] CHRISTMAS ORNAMENT HANGER

[76] Inventors: Dale E. Dieringer, 5195 W. 58th Ave., Ste. 300, Arvada, Colo. 80002; Nikki Powell, 10040 Lewis St., Broomfield, Colo. 80021

[21] Appl. No.: 201,791

[22] Filed: Feb. 25, 1994

[51] Int. Cl.[6] ..... A47H 1/10

[52] U.S. Cl. ..... 248/317; 248/231.8

[58] Field of Search ..... 248/317, 340, 215, 214, 248/231.8; 24/373, 532; D11/121; 223/87, DIG. 4

[56] References Cited

U.S. PATENT DOCUMENTS

| | | | |
|---|---|---|---|
| 2,220,568 | 11/1940 | Fishel | 248/317 X |
| 2,778,157 | 1/1957 | Gratzer | D11/121 X |
| 3,017,059 | 1/1962 | Dzienisiewicz | 223/DIG. 4 X |
| 3,398,839 | 8/1968 | Ballenger | 223/87 X |
| 3,484,070 | 12/1969 | Horodko | 248/317 |
| 3,530,545 | 9/1970 | Lengyel | 24/373 X |
| 3,719,374 | 10/1955 | Paione | 248/317 X |
| 4,738,424 | 4/1988 | Conner | 248/340 |
| 4,966,344 | 10/1990 | Gary | 24/532 X |

*Primary Examiner*—J. Franklin Foss

*Attorney, Agent, or Firm*—Richard W. Hanes

[57] ABSTRACT

A hanger for a Christmas tree ornament, comprising, a stem having two ends with an eyelet at one of the ends thereof, a pair of divergent springable jaws having free ends symmetrically disposed about the extended center of the stem and being attached at a central hinge point which hinge point is integral with the opposing end of the stem, and enlarged end portions carried by each of the free ends of the springable jaws.

3 Claims, 1 Drawing Sheet

CHRISTMAS ORNAMENT HANGER

The present invention relates to a hanger for Christmas tree ornaments.

BACKGROUND OF THE INVENTION

The traditional metal wire hook for hanging a Christmas tree ornament on the branch of the Christmas tree has been in existence for a considerable time but, in spite of its longevity, it possesses some disadvantages. One problem with the hook is the ease with which it can be dislodged from the branch, allowing the fragile ornamental balls to fall and break. Another problem is the difficulty to see the wire hooks as they lay on the floor or carpeting, creating a hazard for vacuum cleaners.

Accordingly, it is the primary object of the present invention to provide an ornament hanger that is easy to place on and around the branch of a tree of any variety, while simultaneously providing a secure hanger that will not be dislodged from the branch without purposeful pulling force.

Other objects, features and advantages will become apparent upon a reading of the following detailed description taken together with the accompanying drawings in which.

DETAILED DESCRIPTION

Figure 2:
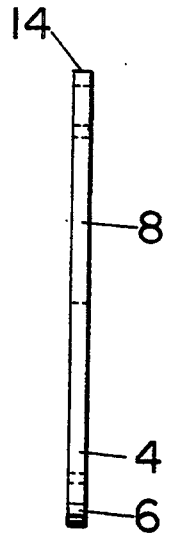
FIG. 2 is a side view of the hanger.
Figure 1:
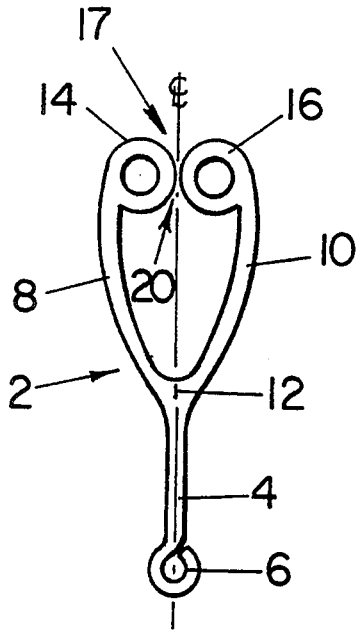
FIG. 1 is a front elevational view of the hanger.
Figure 3:
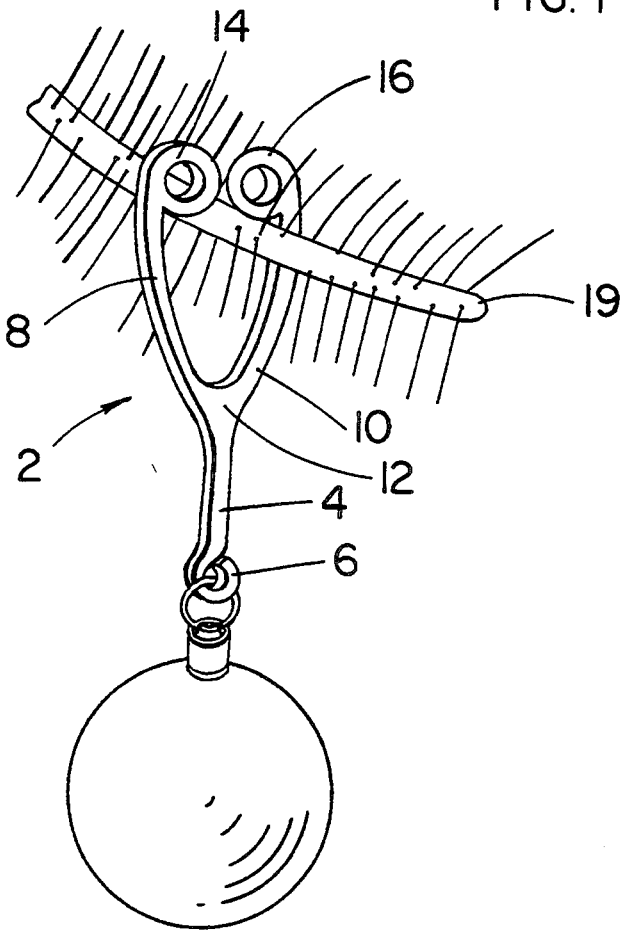
FIG. 3 is a perspective view of the hanger supporting an ornament on the branch of a Christmas tree.

Preferably, the hanger 2 is constructed from a unitary piece of plastic formed in a mold. A stem 4, having an eyelet 6 formed on the lower end thereof, depends from the branch griping jaws 8 and 10. The jaws are springable and diverge from the central hinge point 12. The free ends of the springable jaws terminate in enlarged ends which project inwardly from the jaws to the extended center line of the stem 4.

The enlarged ends 14 and 16 of the jaws can be of various forms however the preferred pattern is that of a circle where the free ends of the jaws merge into the circular plan of each of the enlarged ends tangentially. This arrangement allows the peripheries of the circular shaped ends to be positioned close together on each side of the extended stem center line, but not necessarily to touch each other. The "V" shaped cleavage 17 between the adjacent circularly shaped enlarged ends acts as a camming surface to open the springable jaws when a tree branch 19 is placed within the cleft 17 between the enlarged ends and the hanger is forced against the branch. Responsive to the application of this force on the branch, the jaws open and the branch is enveloped within the space between the jaws and below the enlarged ends. Since the enlarged ends 14 and 16 are biased by the spring pressure of the jaws to be closed to a substantially adjacent position, the branch cannot escape through the space between the ends 14 and 16 from the interior of the space defined by the jaws 8 and 10 and their enlarged ends.

To remove the hanger from the branch a pulling or tensile force on the stem will cause the inverted "V" cleavage 20 beneath the peripheral points of near contact of the enlarged ends to act as a cam surface to again open the jaws and allow the branch to be removed upwardly from the enclosure.

We claim:

1. A hanger for a Christmas tree ornament, comprising, a stem having first and second ends and an eyelet carried by the first end thereof, a pair of divergent springable jaws having free ends symmetrically disposed about the extended centerline of the stem and being joined at a central hinge point which hinge point is integral with the second end of the stem, and enlarged end portions carried by each of the free ends of the springable jaws.

2. The hanger of claim 1 where the enlarged end portions project inwardly toward the extended centerline of the stem.

3. The combination of claim 2 where the enlarged end portions are circular and the springable jaws are tangential to the circular end portions.

* * * * *